United States Patent [19]

Furuichi et al.

[11] 4,390,268

[45] Jun. 28, 1983

[54] CLEANING DEVICE FOR TRANSFERRING SYSTEM WET TYPE COPYING MACHINE

[75] Inventors: Masayoshi Furuichi; Takeshi Honjo; Nobuo Akiba, all of Mitaka, Japan

[73] Assignees: Copyer Co., Ltd.; Canon Inc., both of Tokyo, Japan

[21] Appl. No.: 182,940

[22] Filed: Sep. 2, 1980

[30] Foreign Application Priority Data

Sep. 14, 1979 [JP] Japan ..... 54-118416
Sep. 19, 1979 [JP] Japan ..... 54-121267
Sep. 19, 1979 [JP] Japan ..... 54-121268

[51] Int. Cl.[3] ..... G03G 21/00
[52] U.S. Cl. ..... 355/15; 15/256.51
[58] Field of Search ..... 355/15; 118/652; 15/256.51, 256.52

[56] References Cited

U.S. PATENT DOCUMENTS 3,917,398 11/1975 Takahashi et al. ..... 355/15
4,080,059 3/1978 Tani et al. ..... 355/15
4,259,003 3/1981 Mangal et al. ..... 355/15 X
4,262,999 4/1981 Sato et al. ..... 355/15

*Primary Examiner*—R. L. Moses
*Attorney, Agent, or Firm*—Gerald J. Ferguson, Jr.; Joseph J. Baker

[57] ABSTRACT

A cleaning device for a transferring system wet type electronic copying machine. A cleaning roller is juxtaposed with the photosensitive drum in such a manner that the roller is in contact with the drum so as to absorb developing solution containing toner left on the photosensitive drum. The developing solution containing toner absorbed by the cleaning roller is squeezed out by a cleaning device which depresses the cleaning roller and is then discharged by discharging means.

27 Claims, 16 Drawing Figures

CLEANING DEVICE FOR TRANSFERRING SYSTEM WET TYPE COPYING MACHINE

BACKGROUND OF THE INVENTION

The present invention relates to a cleaning device for a transferring system in a wet-type copying machine.

Previously known cleaning devices used with such a copying machine included a cleaning roller which is turned in the same direction as the direction of rotation of the photosensitive drum of the copying machine by contact with the generating line of the photosensitive drum and a cleaning blade in contact with the outer wall of the photosensitive drum to scrape off toner remaining on the drum. Such devices suffer from a difficulty in that, if the copying machine is not used for a long period of time, the solvent in the developing solution evaporates as a result of which the toner accumulated between the cleaning roller and the cleaning blade is solidified making it difficult to turn the photosensitive drum. At worst, it is completely impossible to start the operation of the copying machine. In addition, the repetitive use of the cleaning roller causes the toner to enter the cleaning roller and to accumulate therein as a result of which the volume and elasticity of the cleaning roller are reduced. Accordingly, the cleaning performance of the cleaning device is lowered and reproduced images become smudged making the quality of the reproduced images unacceptably low.

In order to overcome these difficulties, a method has been proposed in the art in which a developing solution or a solvent is dropped onto the cleaning roller and the cleaning blade to prevent the solidification of the toner. However, that method is disadvantageous in that the evaporation rate of the solvent is considerably increased. In order to eliminate the above-described difficulties, the copying machines must be inspected at shorter maintenance intervals which is bothersome and costly.

In some copying machines, a step is formed at the end of the photosensitive drum to separate a transferring sheet from the drum with a separating guide. More specifically, the transferring sheet is laid on the photosensitive drum in such a manner that it extends slightly beyond the drum in the axial direction thereof so that the transferring sheet is engaged with the separating guide. In such copying machines, the transferring sheet is pulled up by the separating guide and is then forwarded to the following stage. If in this operation the end face of the photosensitive is dirty or stained, a black line is formed on the transferring sheet.

In general, the cleaning roller is made longer than the photosensitive drum of the copying machine. This causes the developing solution to ooze out on both end faces of the drum. However, the end faces of the drum cannot be cleaned with the cleaning roller and are cleaned with the cleaning blade only. Accordingly, a black line may be formed on parts of the transferring sheet which extend beyond the drum along the edge of the end face of the drum.

Furthermore, the toner has a tendency to remain on the blade plate of the cleaning blade. After a copying machine has been operated for a long period of time, the toner will accumulate considerably which lowers the cleaning performance of the cleaning device.

SUMMARY OF THE INVENTION

Accordingly, an object of the invention is to provide a cleaning device for a transferring system wet-type copying machine in which the maintenance interval is long and the cleaning performance for the outer wall of the photosensitive drum and especially for both end faces of the drum is significantly improved.

The foregoing object and other object of the invention have been achieved by provision of a cleaning device including a squeezing member for squeezing out a developing solution containing toner which is absorbed from the surface of a photosensitive drum, an introducing member for introducing the developing solution thus squeezed into a developing solution discharging path, and the developing solution discharging path which is provided below the introducing member. The cleaning roller of the cleaning device is made of an elastic material such as sponge and is disposed in close contact with the photosensitive drum to absorb the developing solution containing toners. Developing solution which might otherwise enter the cleaning roller is squeezed out by the depression of the squeezing member which is juxtaposed with the cleaning roller. The developing solution thus squeezed is introduced through the developing solution introducing member and the developing solution discharging path into the developing device of the copying machine.

DESCRIPTION OF THE PREFERRED EMBODIMENTS

Preferred embodiments of the invention will be described with reference to the accompanying drawings.

Figure 1:
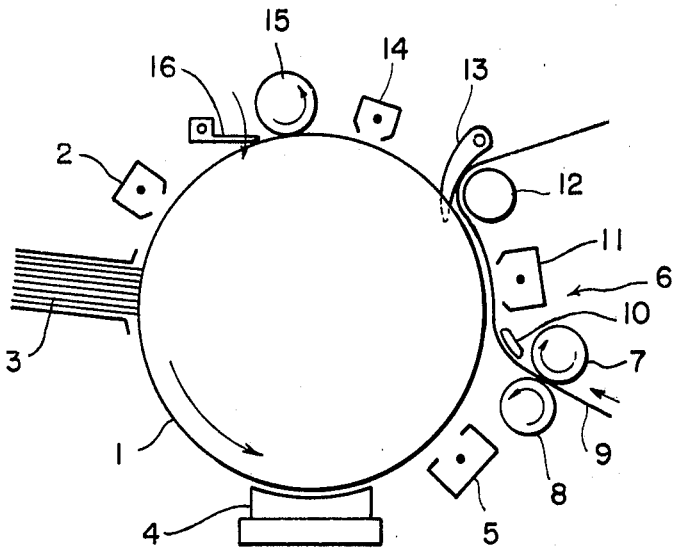
FIG. 1 is a schematic side view showing the general arrangement of a transferring system wet-type electronic copying machine.

FIG. 1 is a schematic side view of a transferring system wet-type electronically controlled copying machine. In FIG. 1, reference numeral 1 designates a photosensitive drum having a photoconductive insulating layer forming its outer wall. The drum 1, which is rotatably mounted on a shaft which is fixedly provided between the two side frames of the copying machine, turns in the direction of the arrow during a copying operation.

An electrode 2 extends parallel to the generating line of the drum 1. The electrode 2 serves as one pole for corona discharge. The image of an original placed on an original positioning plate (not shown) is projected onto the drum by an optical system to form a latent image thereon. The window 3 of the optical system is aligned with the width of the drum 1. A developing device 4 is disposed below the drum 1 at a position such that the outer wall of the drum 1 passes over the developing device 4. The developing device 4 is made up of a developing solution jetting unit provided for jetting a developing solution towards the outer wall of the drum and a developing electrode plate for applying a bias voltage with which is attracted to the latent image to form a visible image.

Following the developing device 4, an electrode 5 is provided to remove excessive amounts of developing solution from the drum. A transferring device 6 is disposed following the electrode 5. The transferring device 6 is provided with conveying rollers 7 and 8 each of which is rotatably mounted on the frames of the copying machine and with each having an axial length equal to that of the drum 1. A transferring sheet 9 is delivered to the conveying rollers 7 and 8. As the conveying rollers 7 and 8 are rotated by a driving device (not shown), the transferring sheet 9 is conveyed in the direction of the arrow while being clamped by the conveying rollers 7 and 8. The sheet 9 is advanced along a stationary guide plate 10 which extends between the side frames of the copying machine in contact with the outer wall of the drum 1. The transferring device 6 further includes a transferring electrode 11 which has a length equal to the axial length of the drum so as to cover the surface of the rotating drum 1.

Following the transferring device 6, a separating roller 12 is provided. The separating roller 12, which has a length equal to the axial length of the drum 1, is rotatably mounted on the frame of the copying machine. The separating roller 12 is provided with a separating guide 13 which is positioned above the surface of the roller 12 adjacent to the surface of the drum 1. More specifically, the separating guide 13 extends slightly inwardly of the drum 1 towards the center of the drum 1 at one end of the drum 1 and along the separating roller 12.

Provided following the separating roller 12 is a cleaning device including a discharging electrode 14, a cleaning roller 15, and a blade assembly 16. The developing solution on the drum 1, from which static electricity has been removed by the discharging electrode 14, is squeezed and wiped off with the cleaning roller 15 and the drum 1 is then scraped with the blade assembly 16.

Figure 2:
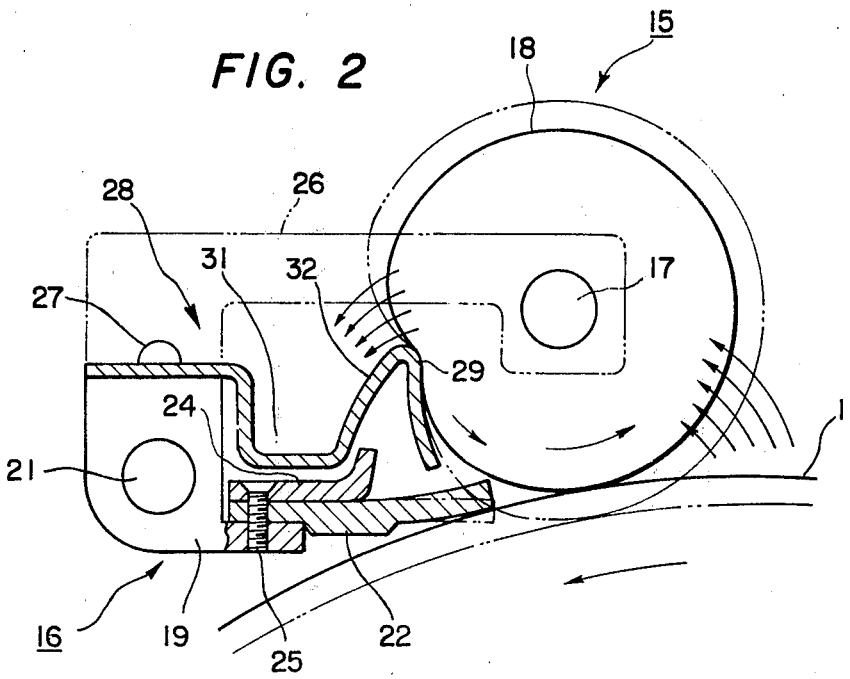
FIG. 2 is a side view, partly as a sectional view, showing a cleaning device constructed according to a first embodiment of this invention.
Figure 3:
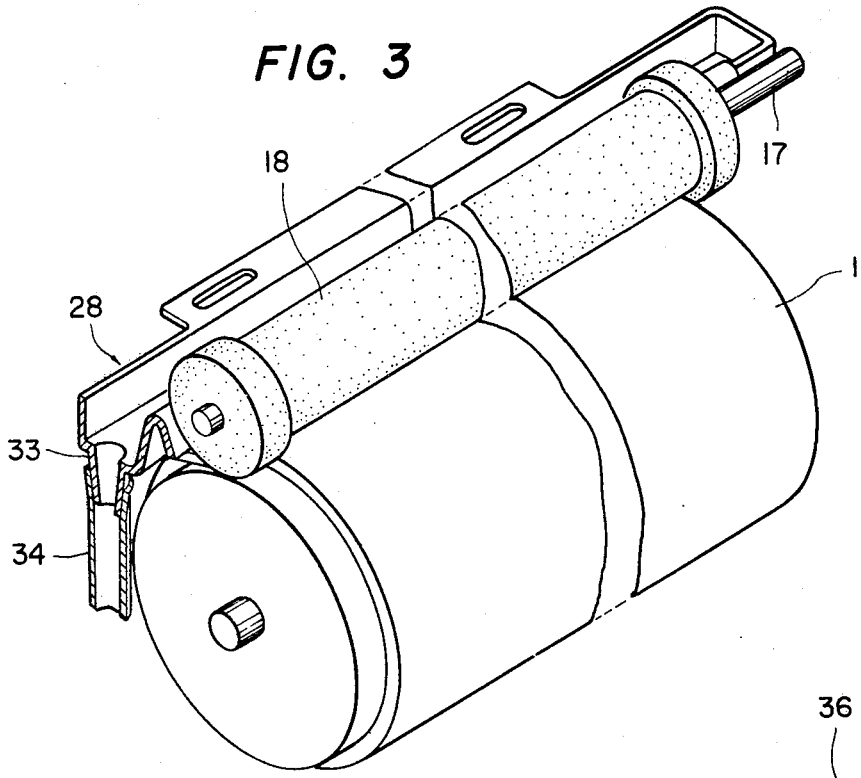
FIG. 3 is a perspective view showing essential components of the cleaning device in FIG. 2.

FIG. 2 is an enlarged view, partly as a sectional view, showing parts of the cleaning roller 15 and the blade assembly 16 in FIG. 1 and FIG. 3 is a perspective view of these same parts. As shown in FIGS. 2 and 3, the squeezing roller 15 has a shaft 17 rotatably mounted on a pair of arms 26 which are fixedly secured to the cleaning blade 16. A roller member 18 which acts as a sponge, is made of an elastic material integrally connected with the shaft 17. The two end portions of the roller member 18 are slightly larger in diameter than the remaining cylindrical portion so that they are brought in close contact with the ends of the drum 1. Furthermore, the main body of the roller member 18 is placed in contact with the outer wall of the drum 1 so as to wipe off the developing solution left on the surface of the drum 1 as illustrated in FIG. 3. During a copying operation, as the drum 1 is rotated counterclockwise in the direction of the arrow, the squeezing roller 15 is also rotated in the same direction sliding on the surface of the drum.

The cleaning blade 16 has a shaft 21 which is rotatably secured to a supporting member 19 which is coupled to both upright side frames (not shown) of the copying machine. The aforementioned arms 26 are fixedly secured to part of the supporting member 19. The cleaning blade 16 is maintained energized by a spring or a solenoid (not shown) in the direction of the arrow in FIG. 1. The operative part of the cleaning blade 16 is a blade 22 one end of which is fixedly secured to the supporting member 19 by retaining screws 25. The other end of the blade 22 is bendable from a normal state, as indicated by the single-dot chain line, to a bend state as indicated by the solid line so as to depress the drum 1.

A developing solution discharging member 28 is fixedly secured to the upper surface of the supporting member 19 by screws 27. The developing solution discharging member 28 is constituted by a squeezing member 29 which depresses the outer wall of the roller member 18 over its entire length deforming the roller member 18 thereby to squeeze out the developing solution absorbed by the roller member 18, an introducing member 32 for introducing the developing solution thus squeezed out to a discharging path 31, and the discharging path 31. The introducing member 32 extends from the squeezing member 29 and serves as a side wall of the discharging path 31 which is in the form of a groove. The two ends of the groove-shaped discharging path 31 are closed and the bottom surface thereof is inclined to cause the developing solution to flow out. A discharging outlet 33 is provided in at least one end portion of the bottom which is connected through a hose 34 to the developing device 4.

The first embodiment of a cleaning device constructed according to the invention is arranged as described above. The operation of this cleaning device will be described. During a copying operation, the drum 1 and the cleaning roller 15 are rotated in the directions of the indicated arrows. The residual developing solution which caused the transfer of a visible image formed on the surface of the drum 1 to the transferring sheet 9 is discharged and conducted to the position of the cleaning roller 15 where the developing solution is wiped off by the roller member 18 sliding along the surface of the drum 1 is absorbed by the roller member 18.

Assuming that the developing solution has a volume of four volume units (indicated by arrows with triangular heads) and one volume unit of residual developing solution is initially held by the roller member 18, then four volume units of developing solution is wiped off and absorbed by the roller member 18. That is, five volume units of developing solution is held by the roller member 18. As the roller member 18 is rotated in close contact with the squeezing member 29, the developing solution held by the roller member 18 is squeezed out to the surface of the roller member 18 above the squeezing member 29. The amount of developing solution squeezed out is four volume units and one volume unit of developing solution is left in the roller member 18. The developing solution thus squeezed out flows along the introducing member 32 to the discharging path 31 flowing along the sloped discharging path 31 to the discharging outlet 33. The developing solution is conducted from the discharging outlet 33 through the hose 34 to the developing device 4 from which it is used again.

The amount of developing solution is decreased in the part of the roller member 18 which is squeezed by the squeezing member 29. As the roller member 18 is turned, the squeezed part is restored or expanded and therefore the held portion of developing solution in the squeezed part is further reduced. Finally, the squeezed part cleans the end portion of the blade 22 and is then brought into close contact with the drum so as to again wipe off the developing solution from the drum 1. This operation is repeatedly and continuously carried out so that the drum is always cleaned satisfactorily and accumulation of toner in the developing solution on the roller member 18 is prevented.

As described above, in the cleaning device of the invention, the developing solution discharging member 28 depresses the roller member 18 to squeeze out the developing solution therefrom so that permeation of toner into the roller member 18 is limited to a certain depth. Accordingly, the roller member 18 is free from solidification of residual toner and the condition of the roller member 18 is maintained substantially equal to that of a new roller member at all times thereby providing a significant improvement of the cleaning effect.

The developing solution is squeezed out of the roller member before reaching the cleaning blade and is returned to the developing device 4 through the discharging path. Therefore, the difficulty that the developing solution sticks to the cleaning blade and causes solidification of toner thereon is eliminated with the use of the invention.

An extremely small amount of toner upon the end portion of the blade 22 is cleaned off the roller member 18. Also, the developing solution is squeezed from both end portions of the roller member 18 and discharged by the developing solution discharging member. Therefore, the ends of the drum are completely cleaned so that no black line is left on the ends of the drum. Furthermore, the developing solution is never splashed in the vicinity of the cleaning device with the result that the solvent evaporated at a slower rate and the amount of developing solution used is reduced.

Figure 4:
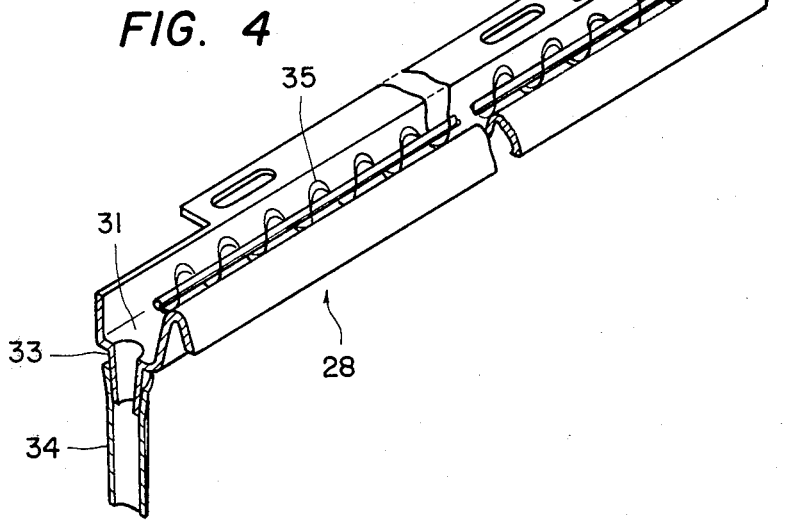
FIG. 4 is a perspective view showing a developing solution discharging member used with the cleaning device of the invention.

FIG. 4 is a perspective view showing a modification of the developing solution discharging member 28 in which a spiral vane 35 is provided in the discharging path 31. The spiral vane 35 has a shaft 36 which is rotatably supported on one end plate of the discharging path 31 and which is coupled to a drive device (not shown). The spiral vane 35 is so designed that its outside diameter is in contact with the bottom of the discharging path 31.

During a copying operation, the spiral vane 35 is rotated to move and discharge toner which otherwise might accumulate in the discharging path 31. The spiral vane 35 may also be provided in the discharging paths of other embodiments of the cleaning device of the invention (described later) providing excellent effects. The provision of the spiral vane 35 prevents a reduction in section of the discharging path after a long period of use thereby resulting in economical use of toner.

Figure 5:
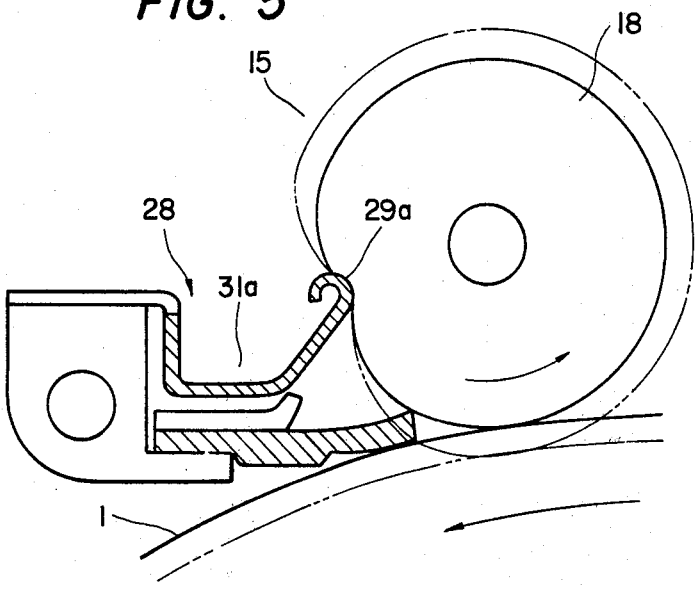
FIG. 5 through FIG. 9 are side views of five examples of the cleaning device shown in FIGS. 2 and 3, respectively.
Figure 6:
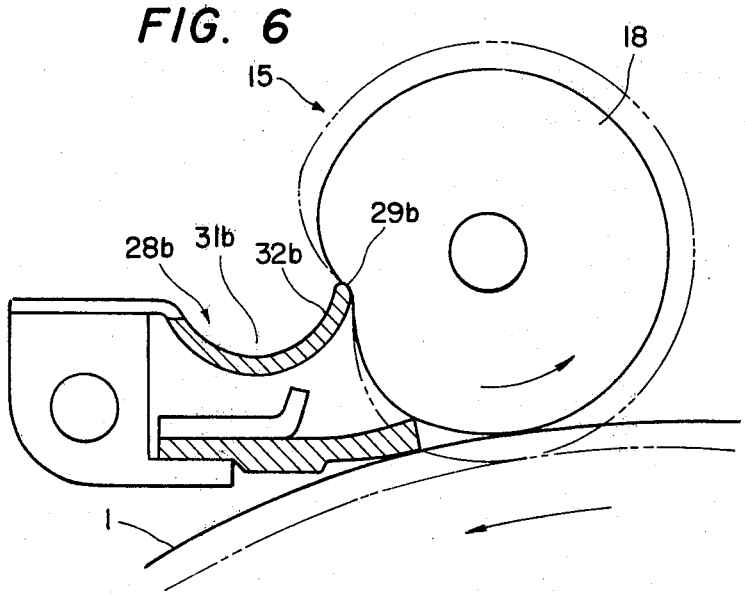
Figure 7:
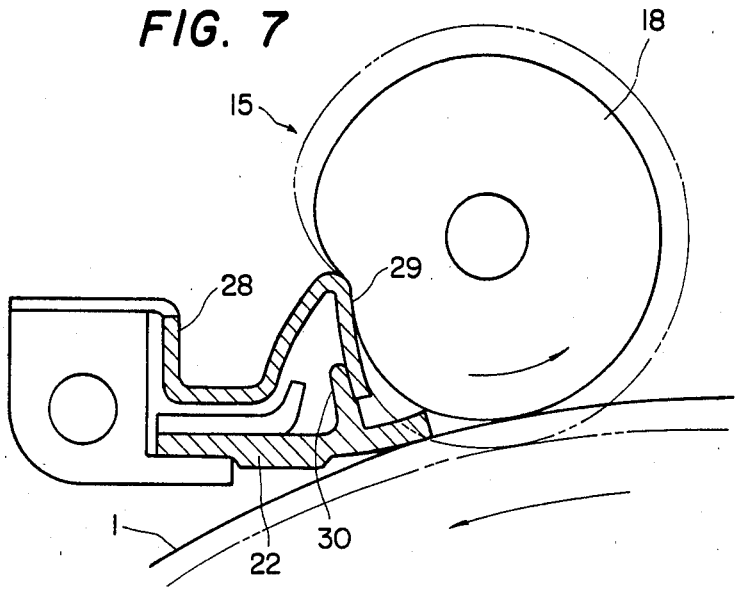

FIGS. 5 through 7 are sectional views taken parallel to the side of the copying machine showing three embodiments of the developing solution discharging member 28 in accordance with the invention.

In FIG. 5, the developing solution discharging member **28*a* is provided with a squeezing member 29*a* the end portion of which is rounded towards a discharging path 31*a***.

In the developing solution discharging member **28*b* shown in FIG. 6, the squeezing member 29*b*, discharging path 31*b* of arcuate section and introducing member 32*b* are formed from a single plate one end of which is rounded. The rounded end of the plate is disposed pushing into the roller member 18. In this embodiment, the accumulation of toner in the discharging path 31*b* is effectively prevented by the provision of the above-described spiral vane 35**. As the thickness of the plate can be increased as desired, this embodiment is particularly suitable for manufacturing the developing solution discharging member with synthetic resin.

In the embodiment shown in FIG. 7, a rib 30 extends from the blade 22 to a position in close contact with the lower end portion of the squeezing member 29 of the developing solution discharging member 28. More specifically, the rib 30 is in close contact with the lower end portion of the squeezing member 29 over the entire length of the blade so as to prevent the transfer of developing solution from below the developing solution discharging member to the upper surface of the cleaning blade 16.

Figure 8:
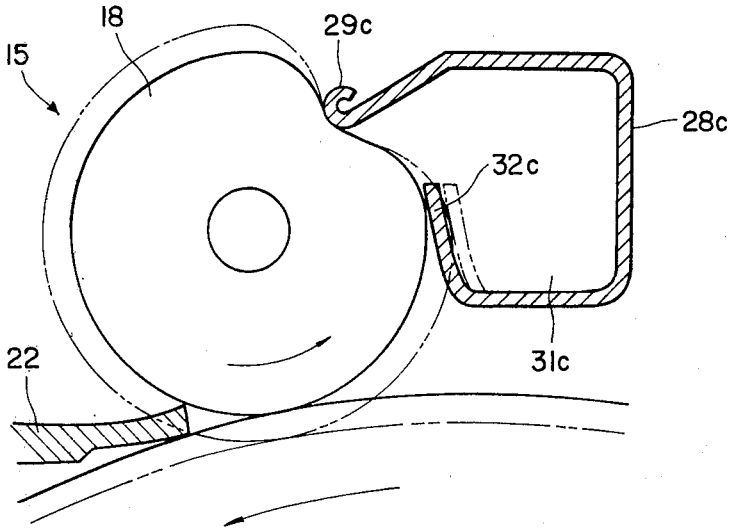

Another embodiment of a cleaning device according to the invention is shown in FIG. 8. In this embodiment, the cleaning roller 15 is disposed between the cleaning blade 16 and a developing solution discharging member **28*c*. The discharging member 28*c* is provided with an opening below the squeezing member 29*c* of which the end portion is disposed pushing against the roller member 18 of the cleaning roller 15. Provided below the opening is an introducing member 32*c* the end portion of which is in close contact with the outer wall of the roller member. A discharging path 31*c* is formed following the introducing member 32*c*. The discharging path 31*c* is longer than the entire length of the roller member 18 and is disposed therealong. Both ends of the discharging path 31*c* are closed. However, a discharging outlet is formed in one end portion of the bottom of the discharging path 31*c***.

Figure 9:
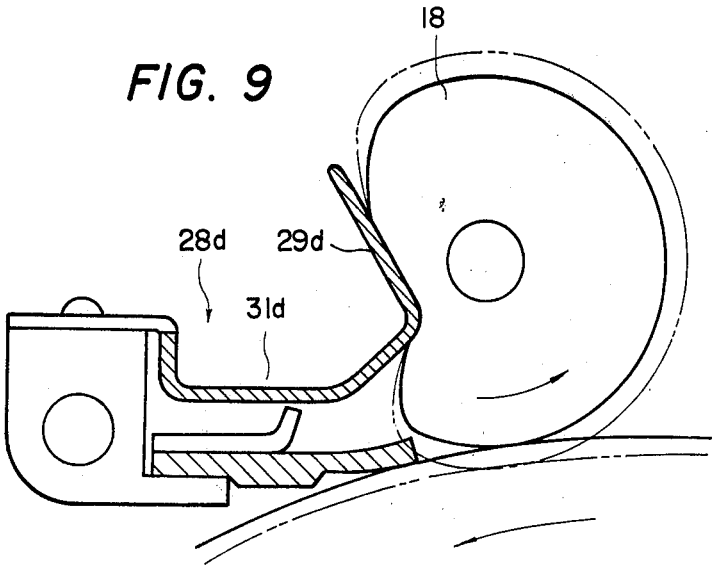

FIG. 9 is a sectional view taken parallel to the side of the copying machine showing another embodiment of the squeezing member. The squeezing member **29*d* forming a part of a developing solution discharging member 28*d* is L-shaped in section. More specifically, as shown in FIG. 9, the squeezing member 29*d* extends from near the upper end of the roller member 18 obliquely towards the center of the roller member 18 and is then bent towards the discharging path 31*d* of the discharging member 28*d*. In this embodiment, as the roller member 18 containing the developing solution turns in the direction of the arrow, the roller member 18 is squeezed gradually. In operation, the upper end portion of the squeezing member 29*d* serves as the introducing member so that the developing solution squeezed out of the roller member drops into the discharging path 31*d*. This embodiment is advantageous in that the roller member 18** is more strongly squeezed.

Figure 10:
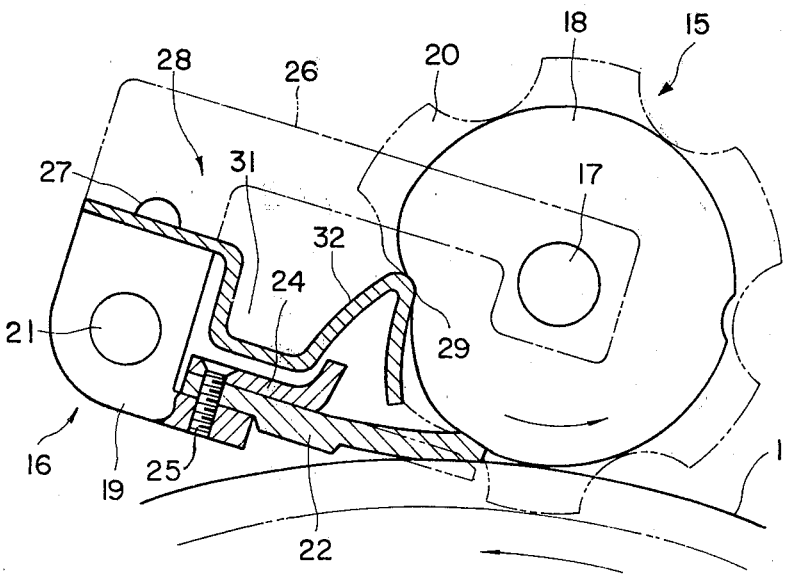
FIG. 10 is a side view, partly as a sectional view, showing a first modification of a cleaning roller in the cleaning device shown in FIGS. 2 and 3.
Figure 11:
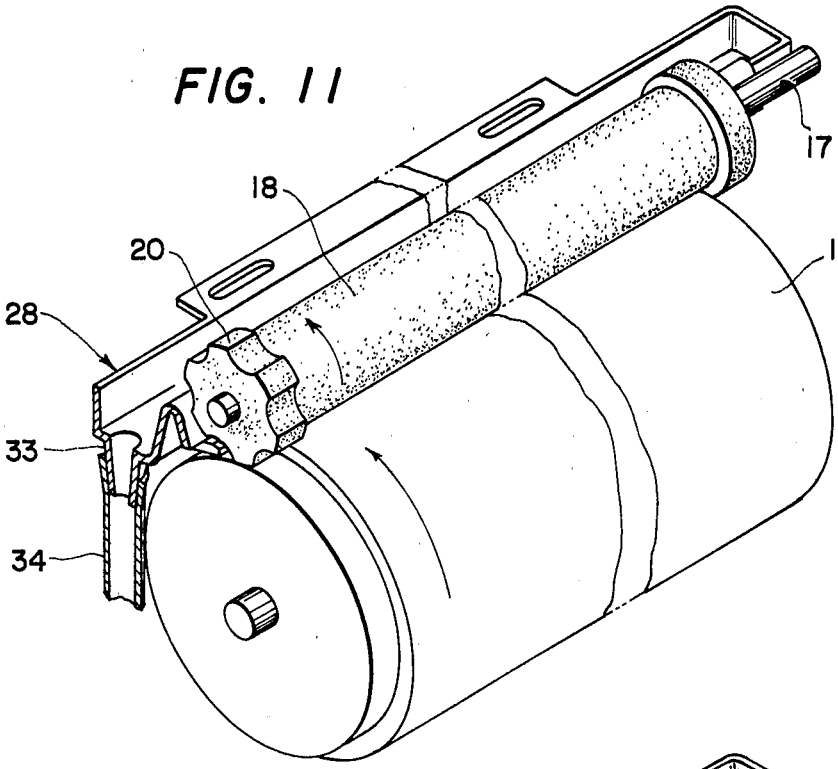
FIG. 11 is a perspective view of the cleaning roller in FIG. 10.

FIG. 10 is a side view, partly as a sectional view, showing another embodiment of the cleaning roller 15 shown in FIG. 2 and FIG. 11 is a perspective view of the same. In FIGS. 10 and 11, those components which have been previously described with reference to FIG. 2 are similarly numbered.

In the embodiment of FIG. 10, a plurality of protrusions 20 extend radially outwardly in the form of a gear from the surface of one end portion of the roller member 18 with a groove arcuate in section formed between adjacent protrusions 20. The roller member 18 is in contact with the drum 1 so that developing solution left on the surface of the drum 1 is wiped off. During a copying operation, as the drum 1 is rotated counterclockwise as shown in FIG. 2, the roller member 18 is also turned in the same direction thus sliding on the surface of the drum 1.

Similar to the embodiment of FIG. 2, the front end portion closer to the drum 1 of the blade plate 22 is provided in the form of a shallow groove. However, the upper edge of the front end portion is chamfered obliquely so as to be in close contact with the roller member 18. The blade plate 22 is preferably made of an elastic material. In FIG. 10, each of the protrusions 20 is substantially trapezoidal in section. However, the protrusions may also have a gear tooth shape or sawtooth shape or may be triangular or rectangular in section.

Figure 12:
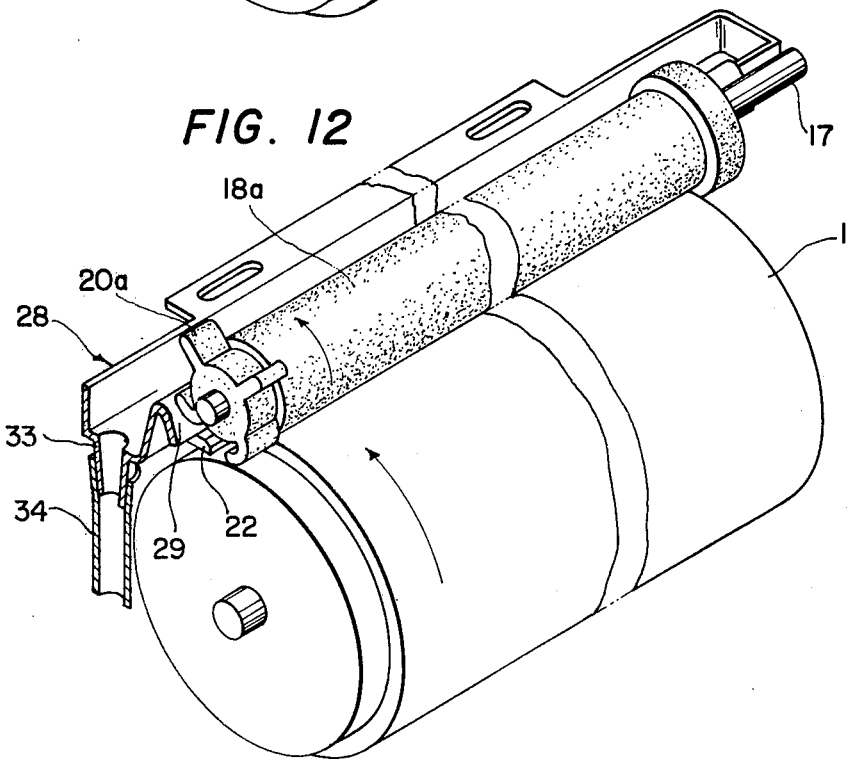
FIG. 12 is a perspective view showing a second modification of the cleaning roller in the cleaning device shown in FIGS. 2 and 3.

FIG. 12 is a perspective view showing another embodiment of the cleaning roller. Here, the roller member 18*a* has end portions which are slightly larger in diameter than the remaining portions thereof. One of the end portions is in the form of an impeller having vanes 20*a*. As the roller member 18*a* turns in the direction of the arrow, each vane 20*a* is squeezed by the squeezing member 29 and then depresses the end portion of the blade plate 22 to clean the blade plate 22. Therefore, the vane 20*a* falls on the step of the drum 1 to clean the end face of the drum 1.

Figure 13:
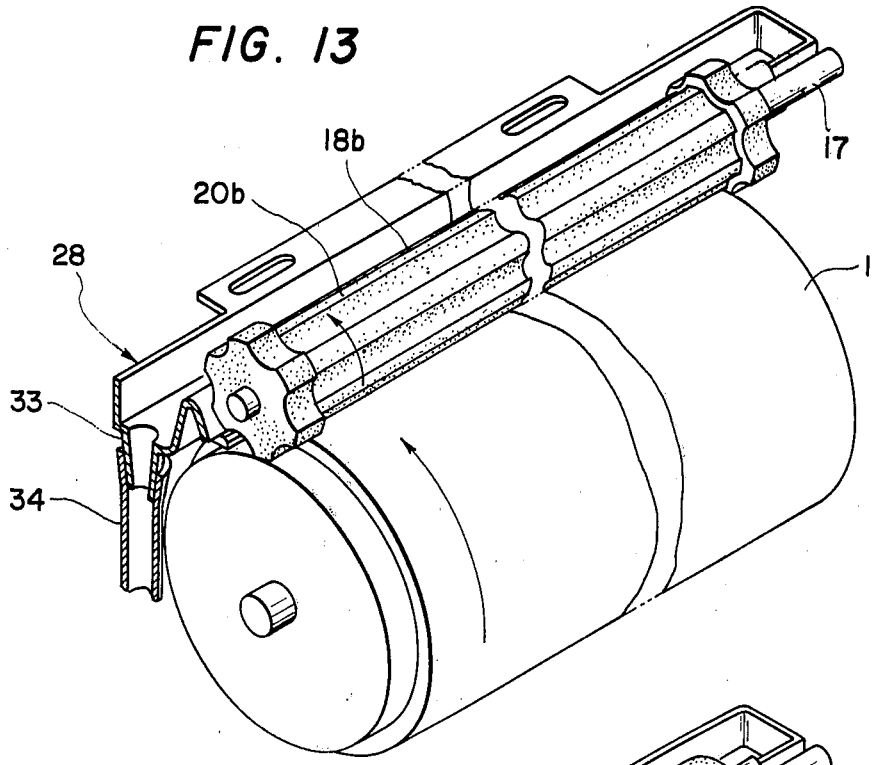
FIG. 13 is a perspective view showing a third modification of the cleaning roller.

FIG. 13 is a perspective view showing another embodiment of the cleaning roller. Here, the roller member 18*b* has end portions which are slightly larger in diameter than the remaining portions between the two end portions. A plurality of protrusions extend radially in the form of a gear from the surface of each of the two end portions similar to the arrangement of FIG. 11. In addition, the middle portion between the two end portions is serrated longitudinally to provide a plurality of protruding stripes 20*b* on the surface. In this embodiment, the roller member 18*b*, upon being turned, cleans the end portion of the blade plate 22 and then springs back to alternately strongly and weakly wipe the outer wall of the drum 1. That is, the roller member 18*b* slides on the surface of the drum intermittently strongly and weakly to remove the developing solution therefrom thereby remarkably improving the cleaning effect.

Figure 14:
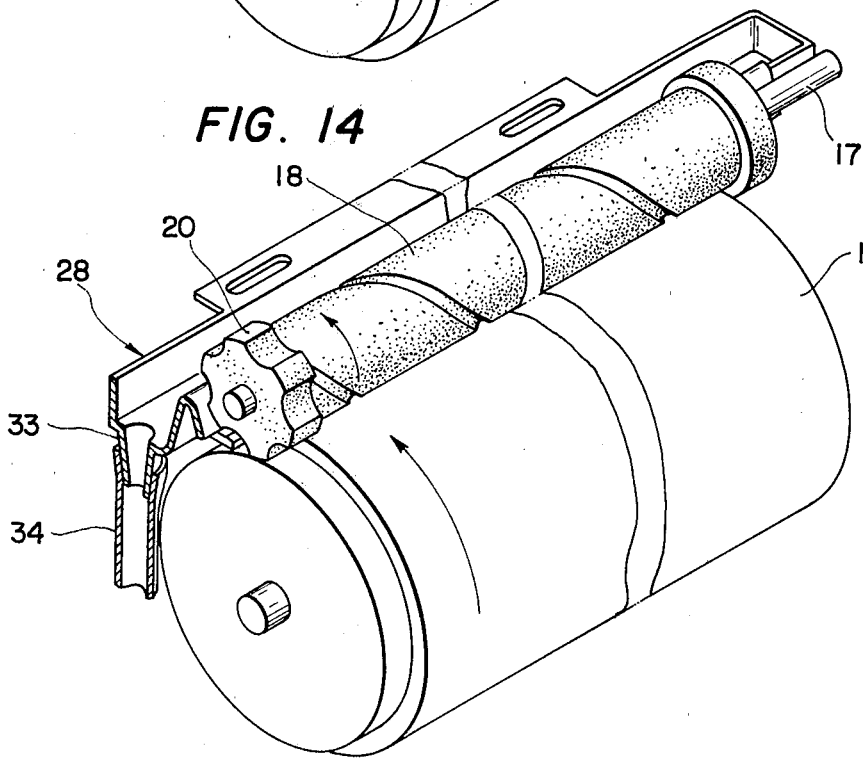
FIG. 14 is a perspective view showing a fourth modification of the cleaning roller.

FIG. 14 is a perspective view showing another embodiment of the cleaning roller. In this embodiment, a spirally threaded groove is cut in the outer wall of the roller member 18. The threaded groove is a left-handed screw in this embodiment. However, it may be of a multi-threaded screw. Alternatively, spirally threaded grooves having different threaded directions may be formed respectively in a first half of the roller part and in the remaining half. Instead of the spirally threaded groove, a screw thread may be spirally formed on the surface of the roller member 18. In both cases, as the number of threads is increased, the screw threads come closer to the screw bottoms and a multi-threaded screw is formed. The preferred thread configuration, the number of threads and the lead will be described later. However, they are so selected as to be effective for moving toner along the axis of the cleaning roller. The roller member 18 may be in the form of a cylinder. In this example, the roller member 18 is provided with end portions which are slightly larger in diameter than the remaining cylindrical portion so that the two end portions are in close contact with the end faces of the drum 1. Similar to the embodiment of FIGS. 10 and 11, a plurality of protrusions 20 are provided extending radially in the form of a gear from the surface of one of the two end portions of the roller member 18.

The operation of the cleaning roller in FIG. 14 will be described. During a copying operation, the drum 1 and the roller member 18 are rotated in the directions of the arrows. In this operation, the residual developing solution which transferred a visible image from the surface of the drum 1 to a copying sheet 9 is discharged and is then moved to the roller member 18. Then, the developing solution is wiped off by the surface of the roller member 18 and is absorbed into the roller member 18. As the roller member 18 turns in close contact with the squeezing member 29, the developing solution thus absorbed is squeezed from the roller member 18 by the depression of the squeezing member 29 as a result of which the developing solution thus squeezed appears on the surface of the roller member 18 before the squeezing member 29. The developing solution then drops into the discharging path 31 and then flows through the discharging outlet 33 and the hose 34 to the developing device 4. The amount of developing solution held by the roller member 18 is decreased because the roller member 18 is squeezed by the squeezing member 29. As the roller member 18 is turned, the squeezed part is restored or expanded. Therefore the amount of developing solution held by the roller member 18 is further decreased. Under this condition, the part of the roller member 18 which has been expanded cleans the end portion of the blade plate 22. In this operation, the remaining developing solution is absorbed or taken up by the roller member 18. However, some toner may be expected to remain on the end portion of the blade plate 22. The toner is conveyed by the spirally threaded groove of the roller member 18 in the axial direction towards the side of the drum opposite to the side where the step of the separation member of the drum is provided. As the roller member 18 is turned, it is again brought into close contact with the drum 1.

Each of the protrusions 20 at the end of the roller member 18 is depressed by the squeezing member 29 so that the developing solution may be squeezed therefrom. The protrusion 20 thus depressed is restored gradually as the roller member 18 turns. However, the protrusion is still compressed by the end portion of the blade plate 22. Therefore, when the protrusion passes through the blade plate 22, the protrusion rebounds to its uncompressed shape upon being abruptly released from the blade plate 22. It then slidably contacts the end face of the drum 1 and the step of the separation part of the drum. Because of the rebound force and the restoration of the roller member 18 to its original configuration, the protrusion is positively brought into contact with the end face of the drum thus especially satisfactorily cleaning the side of the drum where the step of the separation member is provided.

As is clear from the above description, the remaining toner is conveyed in the axial direction of the roller member 18 so as to flow down from the side of the photosensitive drum 1 opposite to the step of the separation member. On the other hand, the toner on the blade plate tends to move away from the step of the separation member of the drum 1. Accordingly, as the toner is accumulated, it is never conveyed to the separation member and thus no black line is formed in the edge portions of a transferring sheet and the separation member where the end portion of the transferring sheet protrudes.

Figure 15:
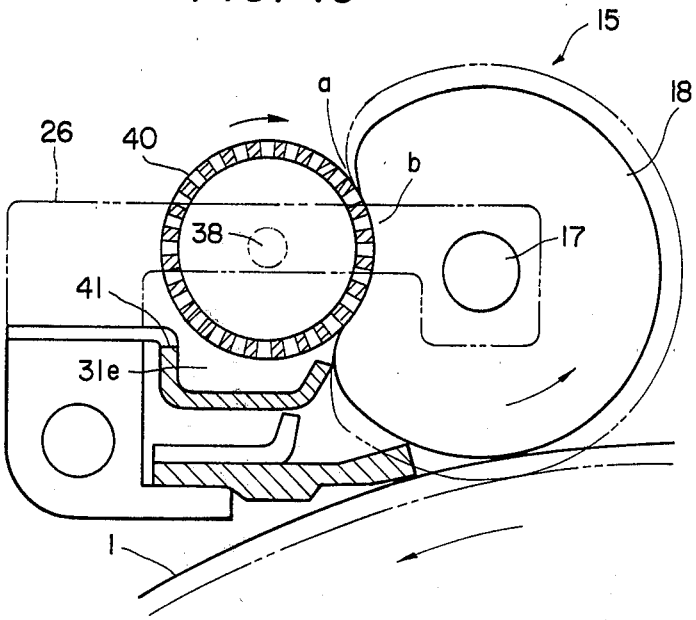
FIG. 15 is a side view, partly as a sectional view, showing the essential components of a cleaning device constructed according to a second embodiment of the invention.
Figure 16:
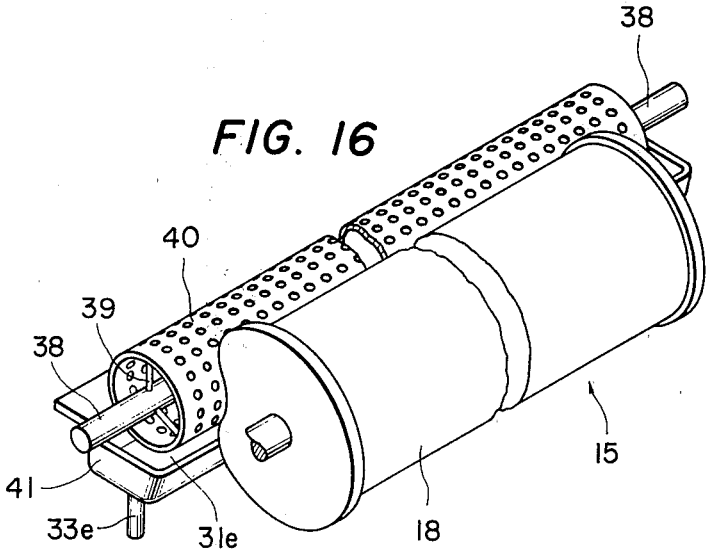
FIG. 16 is a perspective view showing essential components of the cleaning device in FIG. 15.

FIG. 15 is a side view, partly as a sectional view, showing another embodiment of the invention and FIG. 16 is a perspective view of the same. In this embodiment, a cleaning roller shaft 17 is disposed parallel to a shaft 38 which is rotatably supported by arms 26. A cage roller 40 is supported through arms 39 on the shaft 38. The cage roller 40 is formed as a hollow cylinder in the wall of which a number of through-holes are formed. In a copying operation, the cage roller 40 is turned in a direction opposite to the direction of rotation of the roller member 18 as it abuts the roller member 18. The above-described porous cage roller 40 is replaced by a roller made of a net. A gutter 41 is provided below the cage roller 40. The gutter 41 is fixedly secured to the arms 26 so as to provide a discharging path 31*e* which is longer than the cage roller 40. Accordingly, the discharging path 31*e* extends on both ends of the cage roller 40. A discharging outlet 33*e* is formed at one end portion of the discharging path 31*e*.

During a copying operation, the roller member 18 and the cage roller 40 are rotated in the directions of the arrows with the roller member 18 being depressed and squeezed by the cage roller 40. As a result, a part of the developing solution held by the roller member 18 is squeezed out to the position where the roller member 18 and the cage roller 40 come into contact with each other as they rotate and the developing solution thus squeezed flows into the interior of the cage roller 40 through the holes indicated at a. The developing solution squeezed out of the roller part 18 upon being depressed by the cage roller 40 flows into the interior of the cage roller 40 through the holes indicated at b. Depending on the size of the through-holes of the cage roller 40, the developing solution flows through the interior of the cage roller 40 and drops from the end of the cage roller into the discharging path 31*e* near the discharging outlet 33*e*. If the through-holes have a relatively large diameter, the developing solution drops through the lower through-holes of the cage roller 40 into the discharging path 31*e* and then flows from the discharging path 31*e* through the discharging outlet 33*e* to the developing device 4.

In this embodiment, the outer wall of the cage roller 40 serves as a squeezing member while the through-holes and the inner wall serves as an introducing member and the discharging path is separated from the squeezing member and the introducing member.

What is claimed is:

1. In an image-forming apparatus in which an image is formed on a surface of an image-carrying member by a developing solution and is transferred onto a transferring member, a cleaning device for cleaning the surface of the image-carrying member, comprising:

a cleaning roller for cleaning the surface of the image-carrying member, said cleaning roller being disposed in contact with the surface of the image-carrying member;

a blade member for collecting the developing solution on the surface of the image-carrying member, said blade member being disposed in slidable contact with the surface of the image-carrying member and where one end portion of the blade member is in sliding contact with the outer wall of the cleaning roller;

squeezing means for squeezing the developing solution from said cleaning roller; and discharging means for discharging the developing solution squeezed out by the squeezing means.

2. The cleaning device as claimed in claim 1 in which a plurality of protrusions are formed on the surface of said cleaning roller.

3. The cleaning device as claimed in claim 1 in which said cleaning roller has two end portions which are larger in diameter than the remaining portion thereof and which are disposed in close contact with both end faces of said photosensitive drum.

4. The cleaning device as claimed in claim 3 in which protrusions are formed on said two larger diameter end portions of said cleaning roller.

5. The cleaning device as claimed in claim 4 in which said protrusions are provided in the form of gear teeth.

6. The cleaning device as claimed in claim 4 in which said protrusion are provided in the form of an impeller.

7. The cleaning device as claimed in claim 1 in which the outer wall of said cleaning roller is threaded in a manner so as to convey toner remaining on said blade member in the axial direction of said cleaning roller.

8. The cleaning device as claimed in claim 7 in which said cleaning roller has two end portions which are larger in diameter than the remaining portions thereof and which are disposed in close contact with two end faces of said photosensitive drum.

9. The cleaning device as claimed in claim 8 in which protrusions are formed on said two larger diameter end portions of said cleaning roller.

10. The cleaning device as claimed in claim 1 in which said discharging means has a rotatable spiral vane which is rotated to discharge said developing solution containing toner.

11. The apparatus as claimed in claim 1, wherein said squeezing means comprises a squeezing portion and an elongated portion downwardly extending from said squeezing portion.

12. The apparatus as claimed in claim 11, wherein said cleaning blade has a rib portion which is in contact with an end portion of said elongated portion.

13. The apparatus as claimed in claim 1 wherein said squeezing means and said discharging means are formed as a single unit.

14. A cleaning device for a transferring system wet-type copying machine comprising:

a cleaning roller and a cleaning blade for cleaning a photosensitive drum of a developing solution containing toner where said cleaning blade is so arranged that one end portion thereof slides on the outer wall of said cleaning roller;

squeezing means disposed parallel to said cleaning roller for depressing said cleaning roller; and discharging means for receiving and discharging developing solution containing toner squeezed out by said squeezing means.

15. The cleaning device as claimed in claim 14 in which the outer wall of said cleaning roller is threaded in a manner so as to convey toner remaining on said cleaning blade in the axial direction of said cleaning roller.

16. The cleaning device as claimed in claim 15 in which said cleaning roller has two end portions which are larger in diameter than the remaining portions thereof and which are disposed in close contact with two end faces of said photosensitive drum.

17. The cleaning device as claimed in claim 16 in which protrusions are formed on said two larger diameter end portions of said cleaning roller.

18. A cleaning device for a transferring system wet-type copying machine comprising:

a cleaning roller and a cleaning blade for cleaning a photosensitive drum of a developing solution containing toner where a plurality of protrusions are formed on the surface of said cleaning roller;

squeezing means disposed parallel to said cleaning roller for depressing said cleaning roller; and discharging means for receiving and discharging developing solution containing toner squeezed out by said squeezing means.

19. The cleaning device as claimed in claim 18 further comprising introducing means for introducing to said discharging means said developing solution containing toner squeezed by said squeezing means.

20. The cleaning device as claimed in claim 19 in which said squeezing means, introducing means and discharging means are formed as a single unit.

21. A cleaning device for a transferring system wet-type copying machine comprising:

a cleaning roller and a cleaning blade for cleaning a photosensitive drum of a developing solution containing toner where said cleaning roller has two end portions which are larger in diameter than the remaining portion thereof and which are disposed in close contact with both end faces of said photosensitive drum;

squeezing means disposed parallel to said cleaning roller for depressing said cleaning roller; and discharging means for receiving and discharging developing solution containing toner squeezed out by said squeezing means.

22. The cleaning device as claimed in claim 21 in which protrusions are formed on said two larger diameter end portions of said cleaning roller.

23. The cleaning device as claimed in claim 22 in which said protrusions are provided in the form of gear teeth.

24. The cleaning device as claimed in claim 22 in which said protrusions are provided in the form of an impeller.

25. A cleaning device for a transferring system wet-type copying machine comprising:

a cleaning roller and a cleaning blade for cleaning a photosensitive drum of a developing solution container toner;

squeezing means disposed parallel to said cleaning roller for depressing said cleaning roller; and discharging means for receiving and discharging developing solution containing toner squeezed out by said squeezing means where said discharging means has a rotatable spiral vane which is rotated to discharge said developing solution containing toner.

26. The cleaning device as claimed in claim 25 further comprising introducing means for introducing to said discharging means said developing solution containing toner squeezed by said squeezing means.

27. The cleaning device as claimed in claim 26 in which said squeezing means, introducing means and discharging means are formed as a single unit.

* * * * *